United States Patent [19]

Phipps, Sr. et al.

[11] Patent Number: 4,676,162

[45] Date of Patent: Jun. 30, 1987

[54] RUBBER STAMP

[75] Inventors: Cornelius M. Phipps, Sr., Glen Ellyn, Ill.; James Kolff, Cookeville, Tenn.

[73] Assignee: Porelon, Inc., Cookeville, Tenn.

[21] Appl. No.: 745,124

[22] Filed: Jun. 17, 1985

[51] Int. Cl.[4] ..... B41K 1/56; B41K 1/38

[52] U.S. Cl. ..... 101/405; 101/327

[58] Field of Search ..... 101/327, 333, 405, 406

[56] References Cited

U.S. PATENT DOCUMENTS

| | | | |
|---|---|---|---|
| 2,638,049 | 5/1953 | MacPhee et al. | 101/327 |
| 2,900,902 | 8/1959 | Becker | 101/327 X |
| 3,376,812 | 4/1968 | Sterling | 101/327 X |
| 3,402,663 | 9/1968 | Funahashi | 101/327 |
| 3,988,987 | 11/1976 | Ikura et al. | 101/327 |
| 4,022,127 | 5/1977 | Carlsson et al. | 101/327 |
| 4,052,938 | 10/1977 | Kirby | 101/327 X |
| 4,054,093 | 10/1977 | Funahashi | 101/327 |
| 4,182,261 | 1/1980 | Smith, III et al. | 101/327 X |
| 4,203,362 | 5/1980 | Underwood et al. | 101/327 |
| 4,289,070 | 9/1981 | MacGregor | 101/327 |
| 4,362,101 | 12/1982 | Ahrens | 101/327 |

FOREIGN PATENT DOCUMENTS

| | | | |
|---|---|---|---|
| 2332501 | 8/1974 | Fed. Rep. of Germany | 101/327 |
| 2376749 | 9/1978 | France | 101/405 |
| 632550 | 11/1949 | United Kingdom | 101/405 |

*Primary Examiner*—Edgar S. Burr
*Assistant Examiner*—James R. McDaniel
*Attorney, Agent, or Firm*—Lee, Smith & Zickert

[57] ABSTRACT

A rubber stamp with a skirted housing in which a plunger is slideable and spring biased to an upward position. At its bottom end the plunger includes a slotted base to which a print block is removably attached, and at the top end thereof the plunger includes a snap locking cap which permits easy assembly and disassembly of the unit. A frame contains the print block and includes a pair of ribbed flexible arms removably engageable within the slots of the base. Finger tabs connected to the flexible arms are accessible through cutouts in the housing skirt and effective for squeezing and removing the framed print block. A transparent cover is attachable to the housing skirt and covers the inked print block, and abuts the finger tabs so that the print block cannot be moved and inadvertently ink the inside surface of the transparent cover.

7 Claims, 11 Drawing Figures

RUBBER STAMP

BACKGROUND AND SUMMARY OF THE INVENTION

The present invention relates in general to impression stamps, and in particular to an improved rubber stamp having easily assembled and disassembled molded plastic parts, and adapted to accommodate interchangeable print blocks.

Exemplary of the art are the stamps of U.S. Pat. Nos. 3,402,663 and 3,361,799. While these disclosed devices apparently achieve their intended purposes, they are constructed of complicated parts which, once assembled into a completed unit, cannot be disassembled to repair or replace parts thereof.

It is not entirely unknown in the art to construct stamps with removable impression parts. For example, U.S. Pat. No. 3,631,799 discloses removable print stems which can be individually pulled out of the device and replaced with other stems having different stamping indicia thereon. While the stamp of the noted patent does provide a certain degree of versatility, the impression print stems must be wholly removed. Thus, a relatively large inventory of separate stems must be maintained to provide a large variety of stamp impressions. Needless to say, it is time consuming to pick and choose through the inventory of different print stems to select the desired stem and insert it into the stamp.

The present invention overcomes these difficulties encountered in the prior stamps by employing snap lockable parts for easy assembly, disassembly and interchangeability of parts. The invention is constructed so that a print block is removably attached to a plunger which is slideable within a housing, and is covered with a protective cover attachable to the housing to cover the inked print block. Moreover, the protective cover is transparent such that the print indicia on the print block is clearly visible, and further, the print block case abuts with the edge of the protective cover so that the inside surface of the transparent cover cannot become inked because of an inadvertent application of pressure to the print block plunger. More particularly, the rubber stamp of the present invention contemplates a selection of porous print blocks adhered to print block frames which are removably attached to the base of the plunger. Formed with the print block frame are a pair of opposed tabs which, when squeezed together, permit two ribbed arms to become disengaged from respective slots in the print block frame. In another form of the invention the print block is permanently adhered directly to the base of the plunger.

The plunger is slideably movable and spring biased upwardly within a housing sleeve. The plunger also includes at its top end a cap removably attached for pushing against the spring bias and for moving the plunger downwardly in the housing thereby forcing the inked print block onto paper, or the like. A very even and firm ink impression is obtained due to a wide planar shaped configuration for the plunger and its slideable arrangement within the complementarily sized housing sleeve. Thereby, hand pressure atop the cap results in an evenly distributed transfer of downward force upon the print block by virtue of the wide plunger being sidewardly constrained by the sleeve, akin to a piston within a cylinder.

Assembly of the entire unit is easily and quickly accomplished by inserting the plunger into and through the housing and snaplocking the cap thereon. The stamp housing further includes a skirt which surrounds the print block on all sides and extends downwardly further than the print block, except when the plunger is depressed, whereupon the inked print letters extend outwardly slightly more than flush with the edge of the skirt. The transparent protective cover is attachable to the housing skirt. Formed with the print block frame are a pair of opposed tabs which, when squeezed together, permit the ribbed arms to become disengaged from respective slots in the print block frame.

Other features and advantages of the invention will become apparent from the following detailed disclosure, taken in conjunction with the accompanying drawings, wherein like reference numerals refer to like parts.

DETAILED DESCRIPTION OF THE INVENTION

Figure 1:
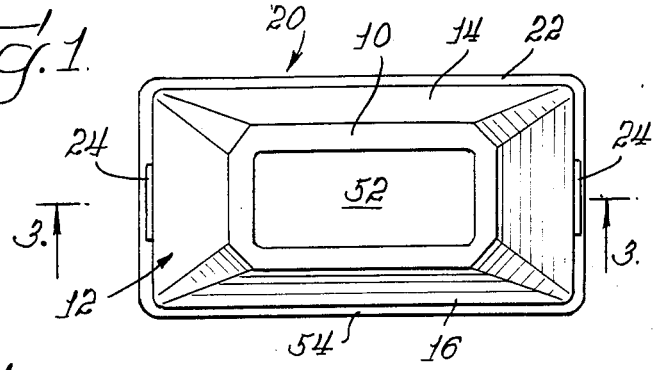
FIG. 1 is a top plan view of the rubber stamp of the present invention.
Figure 2:
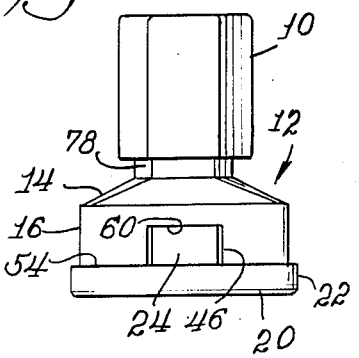
FIG. 2 is a side plan view of the rubber stamp.

Referring now to the drawings, and particularly to FIGS. 1 and 2, there are illustrated the general characteristics of the rubber stamp according to the invention. The rubber stamp includes a cap 10 to which downward pressure may be applied to force an inked impression on paper or the like. A stamp housing 12 is provided which includes a tapered part 14 and a circumferential skirt 16 surrounding a print block 18 (shown in FIG. 3). To protect the print block 18 from dust, or the inadvertent stamping of documents, a transparent protective cover 20, with side walls 22, is attachable to the end of the housing skirt 16. To be discussed in more detail below, a pair of tabs, one shown as reference character 24 in FIG. 2, protrude through respective openings in the housing skirt 16 and are effective in removing the print block 18 from the stamp.

In the preferred form of the invention the cap 10, plunger 30 and housing 12 are formed from acrylonitrile-butadiene-styrene (ABS) resin type plastic. The transparent protective cover 20 is formed out of a polyethylene type of plastic, while a print block frame 26 is an acetal plastic. The print block 18 is a porous type of rubber to absorb and hold ink.

The features and principles of the invention are more readily appreciated by referring now to FIGS. 3–6. As seen from FIGS. 3 and 4 the print block 18 is contained in the frame 26 which depends from, and is removably attached to, a plunger base 28. Importantly, the cap 10 is detachably secured, in manner to be described below, to a planar-shaped plunger 30 which is integrally and orthogonally molded to the base 28. The plunger 30 is slideably movable within a rectangular-shaped sleeve 32 which in turn is molded as part of the housing 12. With this arrangement, when the bottom of the housing skirt 16 is set upon a document and when downward pressure is applied to the stamper cap 10 the print block 18 is correspondingly pushed downwardly into contact with the document. In preferred form, the wide planar-shaped plunger 30 has a width of no less than about one-third of the length of the print block 18 taken in the direction parallel to the plane of said plunger, as best viewed in FIG. 2. Additionally, the sleeve 32 has a height substantially greater than the length of vertical travel made by the plunger 30 therethrough during stamping. The plunger 30 is also made to have a close-tolerance fit within the sleeve 32 so that sideward movement is substantially constrained and the transfer of downward force from the cap 10 to the print block 18 is distributed relatively evenly atop the print block 18. As a result, the ink impression made by the print block 18 on a document is correspondingly even and lateral slipping that might cause smudging, or a double-image, is substantially eliminated. A stable and sure-handed "feel" is experienced by the user, inasmuch as the plunger/sleeve construction compensates for any skewed non-vertical force imparted at cap 10, such as occurs when a hurried worker rushes to complete stamping a series of documents.

Figure 3:
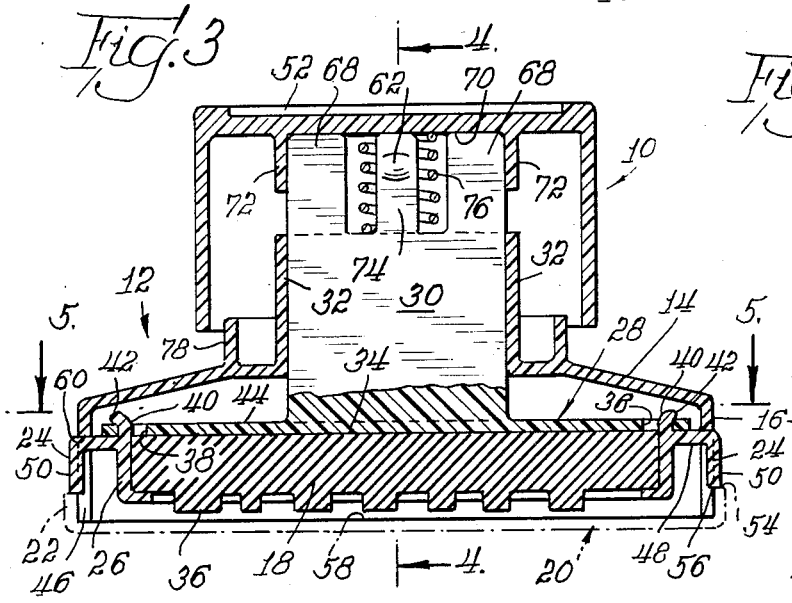
FIG. 3 is a sectional frontal view of the rubber stamp taken along line 3—3 of FIG. 1.
Figure 4:
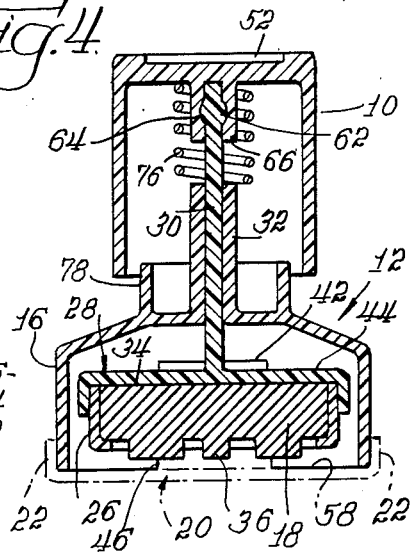
FIG. 4 is a sectional side view of the invention taken along line 4—4 of FIG. 3.
Figure 5:
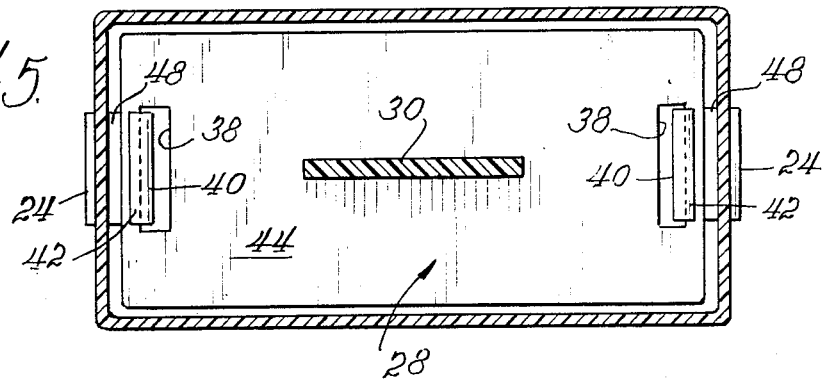
FIG. 5 is another sectional view of the invention taken along line 5—5 of FIG. 3.
Figure 6:
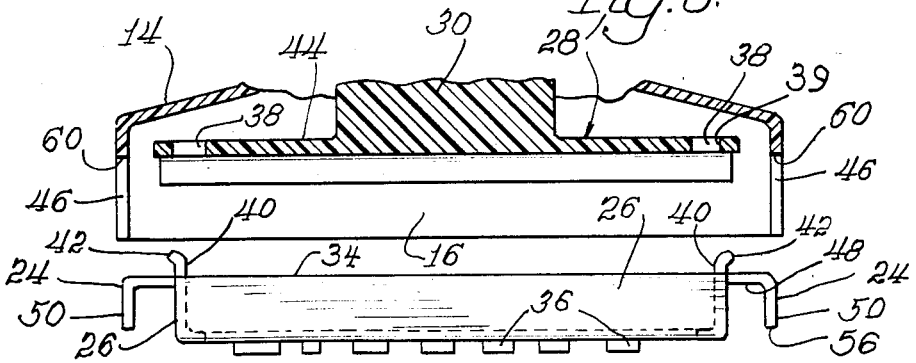
FIG. 6 is a frontal view, partly in section, illustrating the print block and its frame removed from the plunger base.

As noted, to facilitate the assembly or disassembly of the stamp, the upper part of plunger 30 is removably attached to the cap 10 by a ball and socket type of snap lock arrangement. With reference to FIGS. 3 and 4, the top end of the plunger 30 includes a lateral bead 62 on each side thereof, which beads are friction fittable into corresponding grooves 64 of a cap receptacle 66. The receptacle 66 is comprised of depending spaced part planar legs with the grooves 64 formed on the inside surfaces thereof. Around the cap receptacle 66 and the plunger upper section 74 is nested a compression return spring 76 which returns the plunger assembly to its initial upward position after the cap 10 has been depressed and released. Ears 68, also at the top end of the plunger 30, snugly engage with the cap undersurface 70 as well as with the inside surfaces of partitions 72 to enhance the stability of the plunger/cap attachment.

With this construction it can be seen that assembly of the stamp is easily accomplished by simply sliding the plunger 30 through the housing sleeve 32 from below, inserting the spring 76 over the plunger middle section 74 and snapping the cap 10 on the plunger top 74. Disassembly is accomplished by reversing these steps. This is in sharp contrast with prior stamps which comprise many separate parts and thus require considerable time and skill to assemble, or which cannot be disassembled once finally assembled.

In accordance with another feature of the invention the print block 18 is removable and interchangeable on the plunger base member 28. This is highly advantageous as any number of different print blocks can be used with the same stamp device. A noted above, the print block 18 is a porous type of rubber which holds liquid ink applied to it on its top surface 34. Ink is applied to the top surface until the print block 18 is saturated and thus ink is available at a plurality of exposed raised areas 36 which are formed to leave a desired inked impression on paper or the like. The use of porous rubber for the print block is highly desirable as ink is always available on the raised areas 36 and thus a separate ink pad is unnecessary.

A number of print blocks, such as that shown and indicated by reference character 18, with different patterns of raised areas forming different words or numbers, contained in respective frames 26, may be kept on hand and easily interchanged on the plunger base 28 as the need arises. In addiion, should a print block 18 become damaged or worn, it may be easily removed from its frame 26 and replaced with a new print block. The print block 18 is simply laid into the frame 26 from the top, then inked and snapped onto the plunger base 28.

The plunger base 28 includes a pair of slots 38 located on opposing sides of the base. Engageable within these slots 38 are a pair of arms 40, each with an outwardly disposed rib 42. The print block frame 26 is molded integral with the ribbed arms 40 and with the ribbed end of the arm spaced apart slightly greater than the distance between the outside edge 39 of the respective slots 38. In this manner when the arms 40 are slightly compressed and inserted into the respective slots 38, then released, the arms 40 exert an outward pressure on the respective slot outer edges 39. The ribs 42 therefore become engaged with the upper surface 44 of the base 28 and prevent the print block frame 26 from being pulled back through the slots 38 without the reapplication of a compressive force on the arms 40.

In keeping with the invention the print block frame 26 includes a pair of angled tabs 24 formed orthogonal to the ribbed arms 40 and extending through cutouts 46 in the housing skirt 16 for external accessibility. In the preferred form of the invention the angled tabs 24 include an outwardly extending part 48 integral with the vertical top portion 40 of the print block frame 26, and an integral downwardly depending part 50. The application of a compressive force on the downwardly depending tab parts 50 has the effect of flexing the ribbed arms 40 inwardly and releasing the ribs 42 from engagement with their respective slots 38. The sides of the frame 26 bows inwardly when compressed and permits the noted flexing of the ribs 42. Therefore, by the simple application of a compressive force on the tabs 24 the framed print block 18 can be easily removed or installed.

The raised areas 36 of the print block 28 are protected from the inadvertent transfer of ink by a transparent protective cover 20. Preferably, a transparent material is used for the protective cover 20 to facilitate the orientation or the identification of the raised areas 36 visually. For identification purposes, there is also provided a recessed area 52 on the top of the cap 10 for cementing therein a label (not shown) which may also identify the rubber stamp from above.

The protective cover 20 has its peripheral edge upturned to form a side wall 22 frictionally fittable around the housing skirt 16 as shown in FIG. 4. Importantly, the side wall 22 of the protective cover 20 is of a particular length such that the peripheral edge 54 engages with the edge 56 of the downwardly depending tab part 50 and prevents the raised areas 36 of the print block 18 from inadvertently transferring ink to the inside surface 58 of the transparent protective cover 20. The inside surface 58 thus is always clean and the print block raised areas 36 are always visible through the cover 20. With the protective cover 20 thus secured on the housing skirt 16 the print block 18 is rendered immovable within the housing 12 as the finger tab 24 is confined between cover edge 54 and the top edge 60 of the housing cutout 46.

A decorative flange 78 extends upwardly a short distance from the housing 12 between the plunger sleeve 32 and the side of the cap 10. The flange 78 adds strength to the housing 12.

Figure 7:
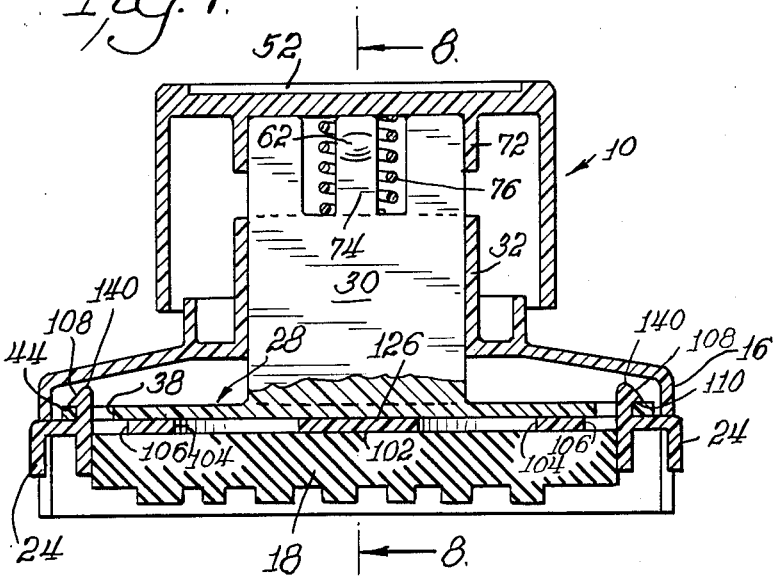
FIG. 7 is a sectional frontal view of the invention illustrating a variation of the print block frame.
Figure 8:
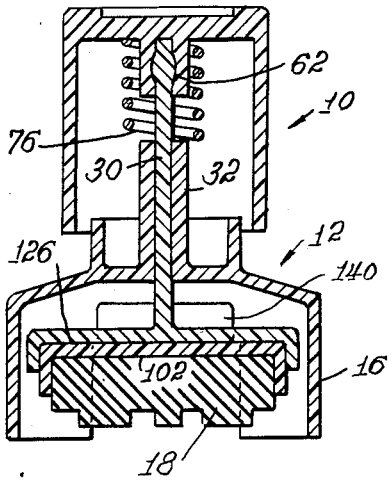
FIG. 8 is a sectional side view of the rubber stamp taken along line 8—8 of FIG. 7.
Figure 9:
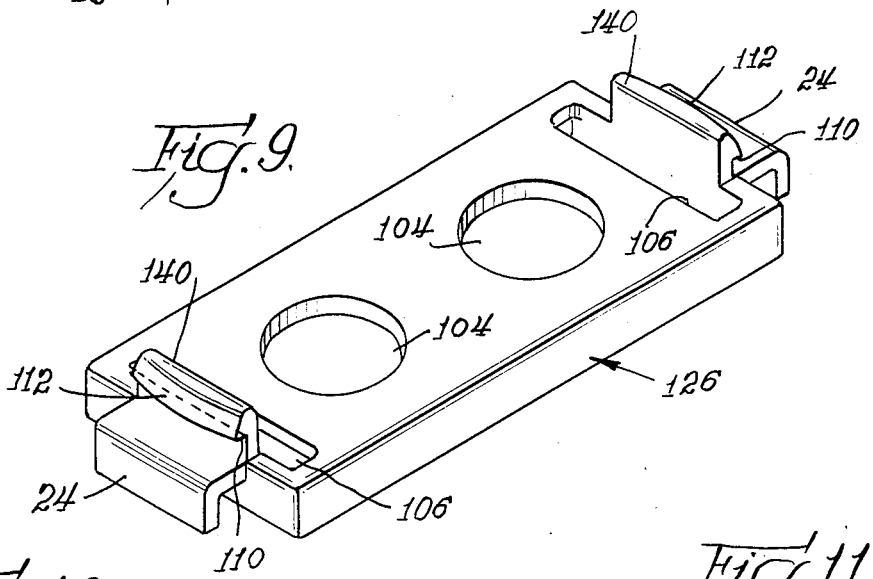
FIG. 9 is an isometric view of the print block frame of FIGS. 7 and 8.

With regard to FIGS. 7–9 there is illustrated another form of a print block frame 126 which ia also removably attached to the plunger base 28. With the exception of this print block frame 126 of FIGS. 7–9 and the plunger base 128 of FIGS. 10–11, all other parts of the stamps of FIGS. 7–11 are identical and are thus identified by the same reference numerals as seen in the previous figures. For clarity, some of the like reference numrals of FIGS. 7–11 are not included in FIGS. 1–6.

As seen in FIGS. 8 and 9, the print block frame 126 is entirely open on the bottom rather than on the top as described in connection with print block frame 26. The print block 18 is adhered, such as by a glue or cement, to underside 102 of the top of the frame 126. Ink holes 104 are provided in the top of the print block frame 126 for saturating the porous print block 18 with liquid ink before the unit is attached to the plunger base 28.

Adjacent each end of the frame 126 is a cutout 106 to provide flexibility to the arms 140 when the tabs 24 are pinched together. Each arm 140 includes a beveled surface 108 to facilitate insertion of the arm 140 into its respective slot 38 on the plunger base 28. In addition, each arm has a flat underside 110 for engaging the plunger base topside 44, and a laterally curved edge 112 for aiding in snap locking, as well as removing, the print block frame 126 from the plunger base 28.

Figure 10:
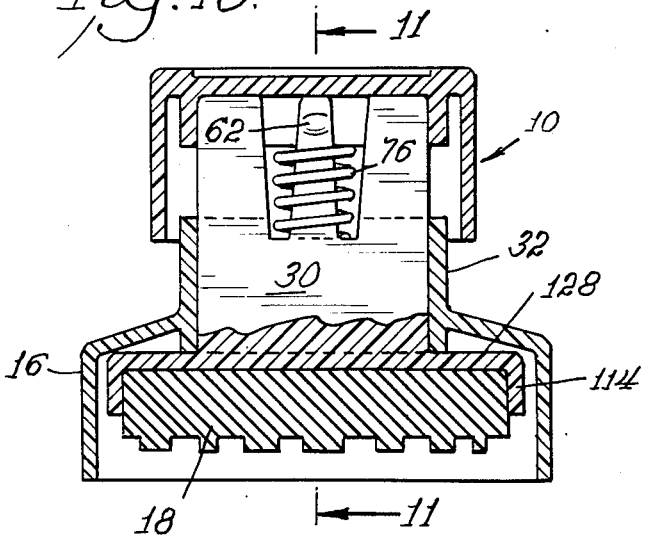
FIG. 10 is a frontal sectional view of yet another embodiment of the invention wherein the rubber print block is adhered directly to the plunger base.
Figure 11:
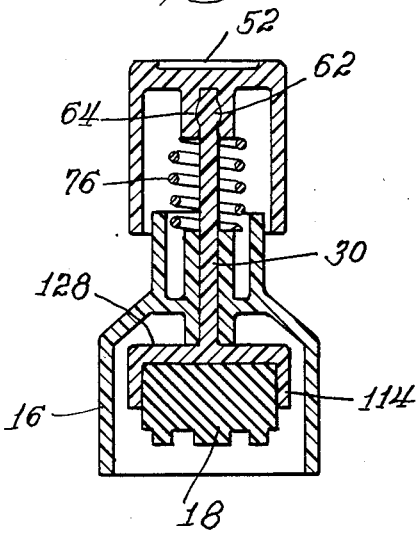
FIG. 11 is a cross-sectional view taken at line 11—11 of FIG. 10.

With reference to FIGS. 10 and 11 the present invention is easily modified by utilizing a slightly different plunger base 128 and adhering the print block 18 directly and permanently to the underside of the base 128. Except for a peripheral lip 114 around the edge of the plunger base 128, it is essentialy identical to the base 28 described in connection with FIGS. 1–8 and thus interchangeable therewith. The peripheral lip 114 laterally contains the print block 18 therein, and provides additional surface area for cementing the print block 18 thereto.

With the feature of the plunger 30 being removably attached to the stamp, it can be seen that any of the described forms of print block attachments can be easily assembled with a single standard cap 10 and housing 12.

From the foregoing, it can be appreciated that the present invention provides a rubber stamp with an easily assembled plunger, cap and housing. Also provided are print blocks which are removably or permanently attached to the plunger, and a protective cover engagable with the print block frame such that ink cannot be transferred from the print block to the inside surface of the protective cover upon an inadvertent depression of the plunger.

Although the invention has been described with a certain degree of particularity it should be understood that this disclosure has been made only by way of example. Consequently, numerous changes in the details of construction will be apparent to those familiar with the art and may be resorted to without departing from the scope of the invention as claimed.

What is claimed is:

1. In a rubber stamp having a plunger integral with a base, a rubber print block with raised indicia areas on which ink is deposited, and means for attaching said print block to said base, wherein the improvement comprises: a frame peripherally encasing said print block such that said raised areas are exposed, and said attachment means comprises snap lock means for removably attaching said frame and thus said print block to said plunger, said snap lock means comprising a pair of spaced slots in said base and wherein said frame includes a pair of similarly spaced flexible arms, each arm having a rib engageable with a respective said slot so that when each said arm is forced through a respective slot said print block becomes removably attached to the base of said plunger, finger tab means for squeezing and flexing each said flexible arm to engage or disengage said arms from said respective slots, and further including a housing slidably engageable with said plunger, said housing including a skirt surrounding said print block and extending peripherally outwardly beyond said raised areas, wherein said skirt includes cutouts through which said finger tab means protrude and are thus easily accessible, a spring biasing said plunger and said housing apart, whereby when said plunger is slidably moved toward said housing said print block moves outwardly and beyond said skirt and becomes exposed for transferring ink deposited thereon.

2. In a rubber stamp having a plunger integral with a base, a rubber print block with raised indicia areas on which ink is deposited, and means for attaching said print block to said base, wherein the improvement comprises: a frame peripherally encasing said print block such that said raised areas are exposed, and said attachment means comprises snap lock means for removably attaching said frame and thus said print block to said plunger and further including a housing slidably engageable with said plunger, said housing including a skirt surrounding said print block and extending peripherally outwardly beyond said raised areas, a spring biasing said plunger and said housing apart, whereby when said plunger is slidably moved toward said housing said print block moves outwardly and beyond said skirt and becomes exposed for transferring ink deposited thereon, and including a transparent cover attachable to the skirt of said housing for covering said print block, wherein said cover further includes a face surface generally covering said print block, and includes sides integral with said face and engageable with said skirt, wherein opposing said sides of said cover are of a predetermined length and include respective edges abuttable with said finger tab means so that downward pressure on said plunger effects an abutment of the edges of said cover with said finger tab means before said inked raised areas contact the inside surface of said face, whereby the inked areas of said print block remain undisturbed when said protective cover is engaged with said skirt.

3. In a rubber stamp having a plunger integral with a base, a rubber print block with raised indicia areas on which ink is deposited, and means for attaching said print block to said base, wherein the improvement comprises: a frame peripherally encasing said print block such that said rasied areas are exposed, and said attachment means comprises snap lock means for removably attaching said frame and thus said print block to said plunger, said plunger having a planar shape and further including a housing integrally formed with sleeve means, said sleeve means slidably accommodating said plunger therein, said housing including a skirt surrounding said print block and extending peripherally outwardly beyond said raised areas, a spring biasing said plunger and said housing apart, whereby when said plunger is slidably moved toward said housing said print block moves outwardly and beyond said skirt and becomes exposed for transferring ink deposited thereon, wherein said plunger is of a width no less than about one-third of the length of said print block, taken in a direction parallel to the plane of said plunger.

4. In a rubber stamp having a plunger integral with a base, a rubber print block with raised indicia areas on which ink is deposited, and means for attaching said print block to said base, wherein the improvement comprises: a frame peripherally encasing said print block such that said raised areas are exposed, and said attachment means comprises snap lock means for removably attaching said frame and thus said print block to said plunger and further including a housing, said housing being integrally formed with sleeve means, said sleeve means slidably accommodating said plunger therein, said housing including a skirt surrounding said print block and extending peripherally outwardly beyond said raised areas, a spring biasing said plunger and said housing apart, whereby when said plunger is slidably moved toward said housing said print block moves outwardly and beyond said skirt and becomes exposed for transferring ink deposited thereon, and wherein said sleeve means is of a height substantially greater than the distance said plunger slidably moves for the exposition of said print block outwardly beyond said skirt.

5. A rubber stamp comprising:

a print block with raised areas carrying ink thereon;

a housing with a depending skirt for housing said print block and for resting said stamp upon a document or the like, wherein said skirt further includes a pair of cutouts, and the housing further having sleeve means integrally formed therewith;

a plunger slidably accommodated in the sleeve means of said housing;

spring means resiliently biasing said plunger and said housing apart;

snap lock means for removably attaching said print block to said plunger;

finger means comprising a pair of tabs connected to said snap lock means and extending through said cutouts and being accessible external to said housing for activating said snap lock means to thereby remove said print block from said plunger.

6. A rubber stamp comprising:

a print block with raised areas carrying ink thereon;

a housing with a depending skirt for housing said print block and for resting said stamp upon a document or the like, and the housing further having sleeve means integrally formed therewith;

a plunger having a planar-shape slidably accomodated in the sleeve means of said housing, wherein said plunger is of a width no less than about one-third of the length of said print block, taken in a direction parallel to the plane of said plunger;

spring means resiliently biasing said plunger and housing apart;

snap lock means for removably attaching said print block to said plunger;

finger measn accessible external to said housing for activating said snap lock means to thereby remove said print block from said plunger.

7. A rubber stamp comprising:

a print block with raised areas carrying ink thereon;

a housing with a dependent skirt for housing said print block and for resting said stamp upon a document or the like, and the housing further having sleeve means integrally formed therewith;

a plunger slidably accommodated in the sleeve means of said housing;

spring means resiliently biasing said plunger and housing apart;

whereby when said plunger is slidably moved toward said housing said pring block moves outwardly and beyond said skirt and becomes exposed for transferring ink deposited thereon; and wherein said sleeve means is of a height substantially greater than the distance said plunger slidably moves for the exposition of said print block outwardly beyond said skirt;

snap lock means for removably attaching said print block to said plunger; and, finger means accessible external to said housing for activating said snap lock means to thereby remove said print block from said plunger.

* * * * *

UNITED STATES PATENT AND TRADEMARK OFFICE

CERTIFICATE OF CORRECTION

PATENT NO. : 4,676,162

DATED : June 30, 1987

INVENTOR(S) : Cornelius M. Phipps, Sr., and James Kolff

It is certified that error appears in the above-identified patent and that said Letters Patent are hereby corrected as shown below:

At Col. 4, line 51, immediately after the word "block" please delete the number "28" and insert therefor — 18 — .

At Col. 8, line 34, immediately before the word "block" please delete the word "pring" and insert therefor — print — .

Signed and Sealed this

Twenty-sixth Day of April, 1988

*Attest:*

*Attesting Officer*

DONALD J. QUIGG

*Commissioner of Patents and Trademarks*